United States Patent [19]

Osborn et al.

[11] Patent Number: 4,787,313

[45] Date of Patent: Nov. 29, 1988

[54] PRINTING PRESS USING SHIFTABLE INKING MEANS

[75] Inventors: Wayne L. Osborn; Paul D. Naab, both of Emporia, Kans.

[73] Assignee: Didde Graphic Systems Corporation, Emporia, Kans.

[21] Appl. No.: 61,645

[22] Filed: Jun. 19, 1987

Related U.S. Application Data

[63] Continuation of Ser. No. 857,150, Apr. 29, 1986, abandoned.

[51] Int. Cl.[4] ..... B41F 31/08

[52] U.S. Cl. ..... 101/366

[58] Field of Search ..... 101/366, 365, 350, 363, 101/207-210, 148

[56] References Cited

U.S. PATENT DOCUMENTS

| | | | |
|---|---|---|---|
| 2,890,652 | 6/1959 | Jauch et al. | 101/366 X |
| 3,345,943 | 10/1967 | Rakowicz et al. | 101/366 |
| 3,541,959 | 11/1970 | Taffel et al. | 101/366 |
| 4,281,597 | 8/1981 | Dressler | 101/366 |
| 4,469,024 | 9/1984 | Schwartz et al. | 101/366 |
| 4,535,693 | 8/1985 | Belvederi | 101/366 |

FOREIGN PATENT DOCUMENTS

| | | | |
|---|---|---|---|
| 16483 | 3/1956 | Fed. Rep. of Germany . | |
| 2011702 | 3/1970 | Fed. Rep. of Germany | 101/366 |
| 0014749 | 1/1983 | Japan | 101/366 |
| 0207250 | 11/1984 | Japan | 101/365 |
| 2074240 | 10/1981 | United Kingdom | 101/366 |

*Primary Examiner*—J. Reed Fisher

*Attorney, Agent, or Firm*—Hovey, Williams, Timmons & Collins

[57] ABSTRACT

An ejection-type inking assembly for use in printing presses is provided which gives precise, readily alterable ink application to an inking roll train and eliminates conventional ink fountains and associated adjustable ink keys. The inking assembly preferably includes a shuttle-mounted reciprocal inking unit having an ink ejector nozzle, a supply of ink and a feed pump for pressurizing successive charges of high viscosity ink and delivering the charges at a constant flow rate to the nozzle. The preferred pump is a twin screw, counter rotating positive displacement device driven by means of a stepper motor. As the inking unit traverses an ink-receiving roller, the stepper motor is activated for precise periods of time correlated with the position of the unit, so as to deliver measured, variable quantitites of ink for each respective increment of distance traveled by the inking unit. In practice, the copy plate is electronically scanned to ascertain the amount of ink needed for each strip zone on the copy, and this information is employed with appropriate microprocessor control to operate the pump stepper motor as required to deliver the proper variable quantitites of ink to the ink train during translation of the inking unit along the length of the ink-receiving roller. Use of a shiftable inking unit including the ink supply, pump and motor eliminates long, high pressure ink feed lines and minimizes ink wastage, particularly in short printing runs.

8 Claims, 4 Drawing Sheets

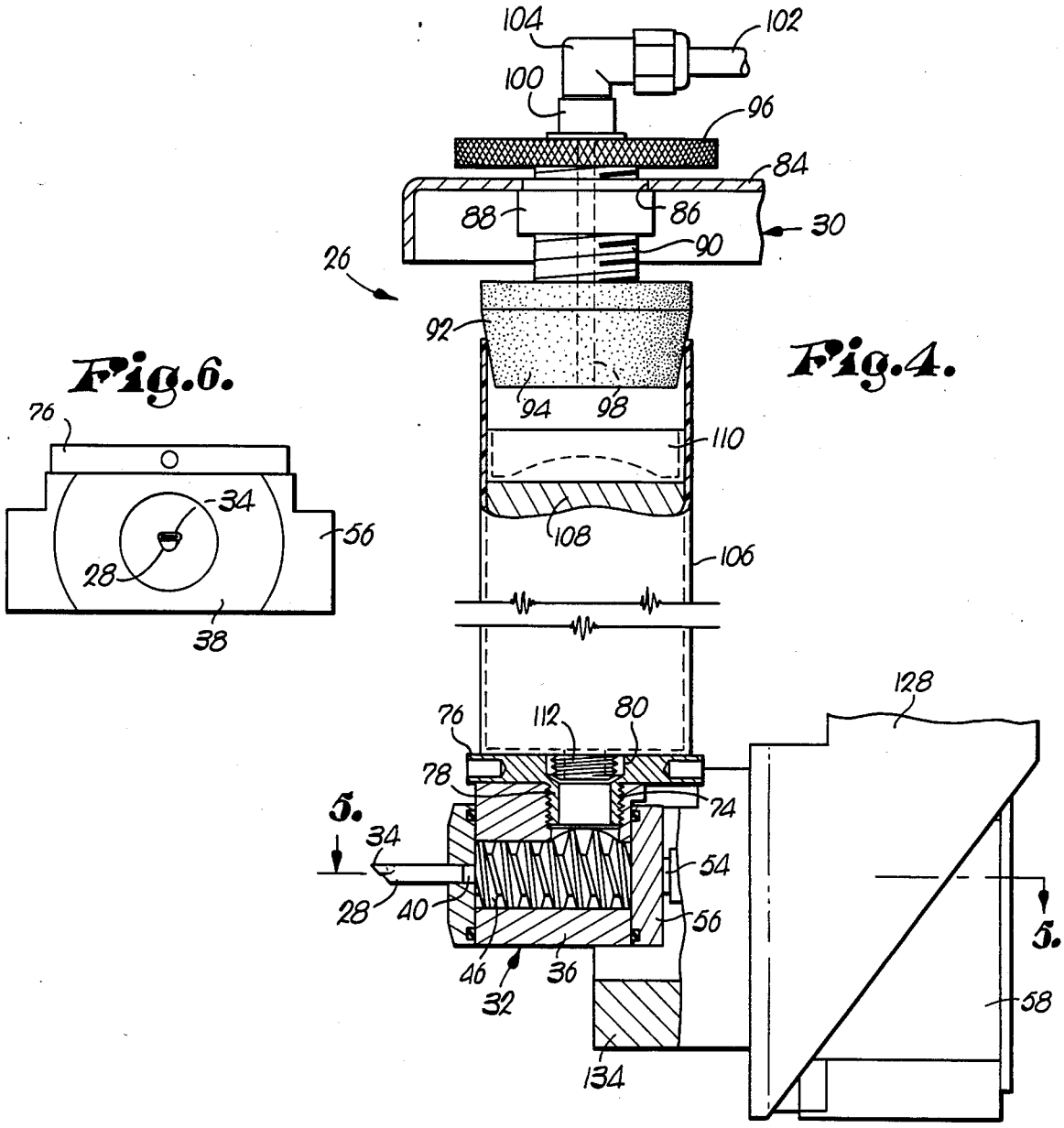
Fig.4.
Fig.6.
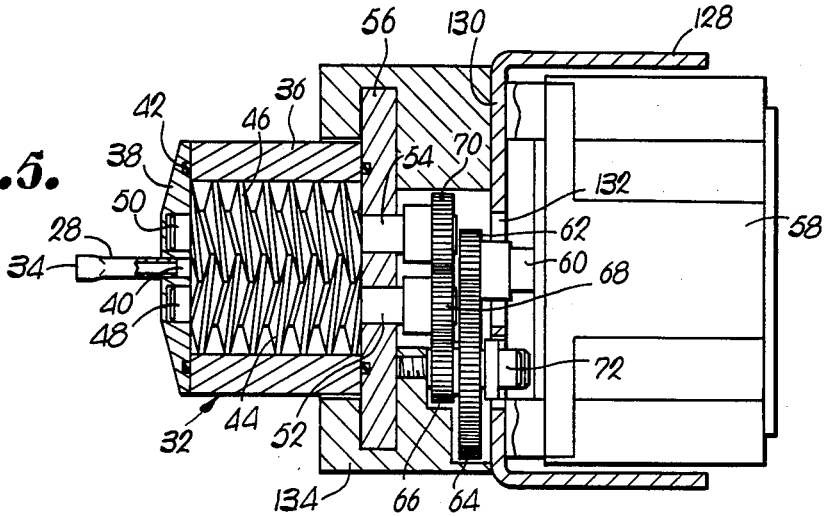
Fig.5.

PRINTING PRESS USING SHIFTABLE INKING MEANS

This application is a continuation, of application Ser. No. 06/857,150, filed Apr. 29, 1986, now abandoned.

BACKGROUND OF THE INVENTION

1. Field of the Invention

The present invention is broadly concerned with an inking assembly adapted for mounting on a web or sheet-fed printing press of the type including a multiple-roller inking train. More particularly, it is concerned with such an inking assembly making use of a shiftably mounted, reciprocal ink ejector for delivering precise quantities of ink to at least one ink-receiving roller as the ejector assembly traverses the roller. In this manner, the use of conventional ink fountains, fountain rollers and associated adjustable inking keys is completely eliminated.

2. Description of the Prior Art

In the printing of copy it frequently occurs that the ink requirements across the width of the copy are not the same column by column or zone by zone. In some of the column positions there may be heavily pigmented areas as, for example, a half tone illustration with a dark background. This situation would require more ink to be fed in that column, as compared with other columns or zones across the copy which are only lightly pigmented, or have no printed areas of a particular color.

In order to accommodate these differential ink requirements, printing presses have long been provided with adjustable inking systems. These typically include an inking train made up of a number of rollers including an inking fountain roller, and ductor and distribution rollers. In addition, such presses include an adjustable fountain doctor blade which can be adjusted zone by zone along the length thereof by means of so-called inking keys. Such keys are manipulated by the printer in order to apply the requisite differential quantities of ink across the width of the inking train, and hence ultimately to the sheet or web to be printed.

Use of conventional inking keys presents a number of problems, however. Thus, adjustment of the keys can be a time consuming process and may require considerable operator skill. While this problem may not be of paramount importance when long printing runs are contemplated, in the case of short runs the make-ready associated with inking key adjustments can represent a considerable cost to the printer, in terms of time and paper and ink wastage. The typical doctor blade is fabricated from a sheet of flexible spring metal. Ink key adjustment flexes the blade in the immediate area of that particular key. Experience has shown that adjustment of one key inevitably affects the performance of adjacent keys. Thus, many, many adjustments may be required in order to achieve quality printing results.

An adjustable fountain blade may also increase the horsepower requirements needed for rotation of the fountain roller. That is to say, many inks are highly viscous, gel-like substances, and in order to rotate the fountain roller against the adjustable blade, considerable horsepower can be needed.

Attempts have been made in the past to provide automatic control of the inking keys, making use of motorized adjustments and micro-processor control. However, these units are relatively expensive because of the need to provide multiple motors for the respective key adjustments.

It has also been suggested in the past to employ segmented fountain blades each including a respective adjustment key. This overcomes the noted problem of a given key adjustment affecting the performance of adjacent keys, but provides a relatively complex structure which is expensive and difficult to control. Moreover, the segmented blades are prone to leakage and can be difficult to clean.

For all of the foregoing reasons then, use of conventional fountain rollers and key-adjusted fountain blades presents considerable practical difficulties in terms of cost and operational efficiencies to the printer. There is therefore a decided need in the art for an improved inking system which completely eliminates the need for a fountain roller, associated blade, and adjustment keys while at the same time giving precise, readily adjustable inking control.

SUMMARY OF THE INVENTION

The present invention overcomes the problems described above, and provides a greatly improved inking assembly adapted for mounting adjacent one or more ink-receiving rollers of a printing press. Broadly speaking, the inking assembly of the invention includes ink supply means having ink delivery means presenting an ink passageway (e.g., an elongated ink nozzle), means adjacent the delivery means for supplying ink, and selectively actuatable feeding means operatively coupling the ink supply means and the delivery means for selective delivery of ink from the supply to the nozzle. The ink supply means is mounted with the delivery means thereof adjacent the ink-receiving roller, and also for translatory movement of the entire ink supply means along a path of travel extending axially along the length of the roller. Finally, control means is provided for operating the ink feeding means so as to deliver preselected, variable quantities of ink to the roller(s) depending upon the sensed position of the ink supply means along the length of the roller.

In preferred forms of the invention, the ink feeding means includes apparatus for pressurizing successive charges of ink from the ink delivery means and for delivering such charges to the nozzle means. One particularly appropriate feeding means would be a positive displacement pump device. In present practice, a pump is provided having a housing and a pair of inter-meshed, counter-rotating screw members within the housing. The delivery means here in the form of an ejector nozzle is in turn operatively coupled with the housing whereby rotation of the screw members serves to deliver constant flow rate, pressurized charges of ink to the ejector nozzle. The pump device is advantageously powered by means of an adjacent stepper motor which is shiftable with the pump and ink supply.

In the preferred device, the stepper motor is actuated to operate the positive displacement pump as the ink supply means enters each respective zone along the length of the ink-receiving roller. Digital electronic micro-processor control is employed for operating the stepper motor.

BRIEF DESCRIPTION OF THE DRAWINGS

FIG. 4 is an enlarged, fragmentary view in partial vertical section illustrating the construction of the preferred ink supply, pump and ejector nozzle;

FIG. 5 is a sectional view taken along line 5—5 of FIG. 4 and further depicting the details of construction of the preferred twin screw positive displacement ink pump;

FIG. 6 is a front elevational view of the ink pump and ejector nozzle;

DESCRIPTION OF THE PREFERRED EMBODIMENT

Figure 1:
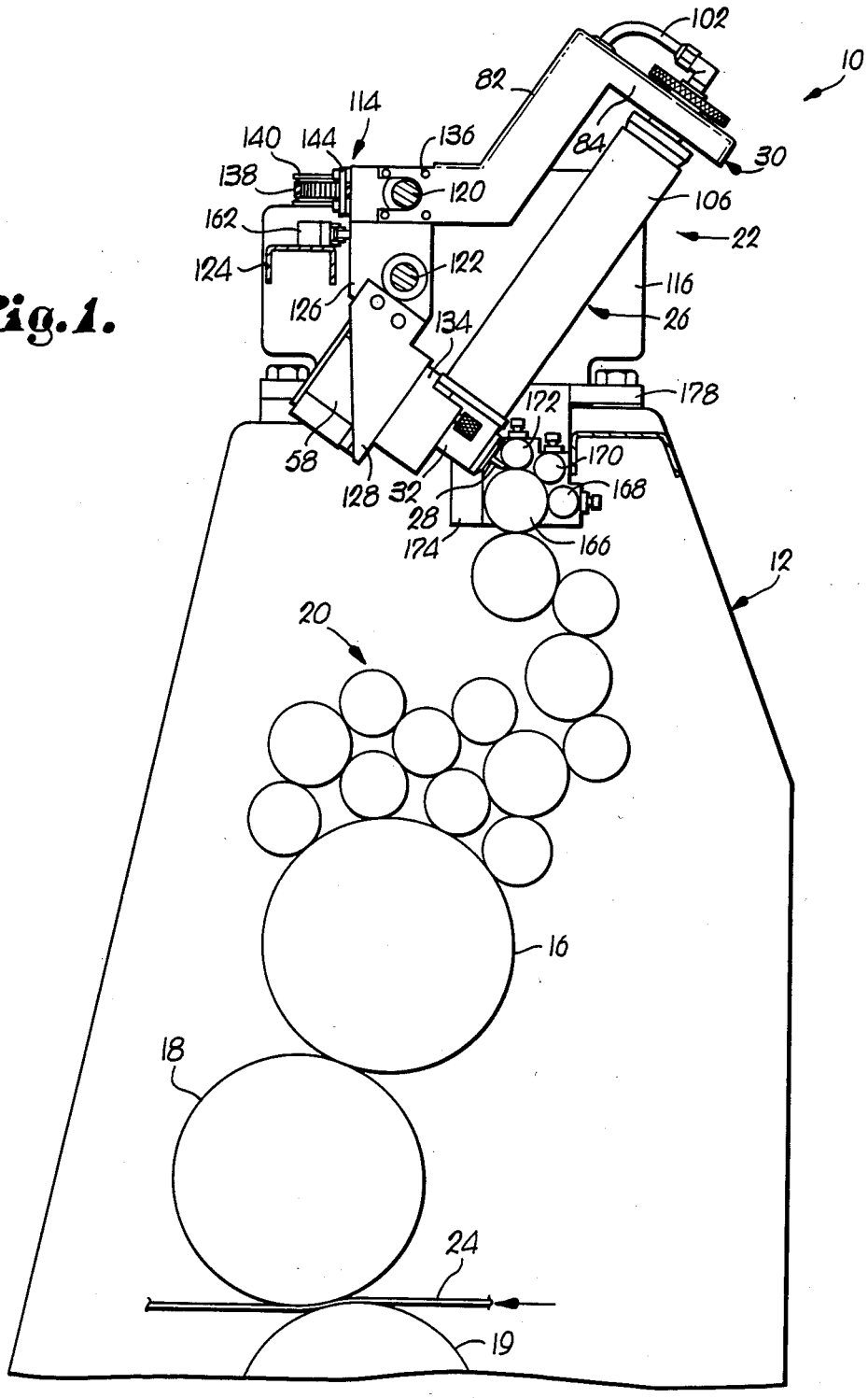
FIG. 1 is a partially schematic vertical sectional view illustrating a small web fed printing press with the inking assembly of the present invention mounted thereon.
Figure 3:
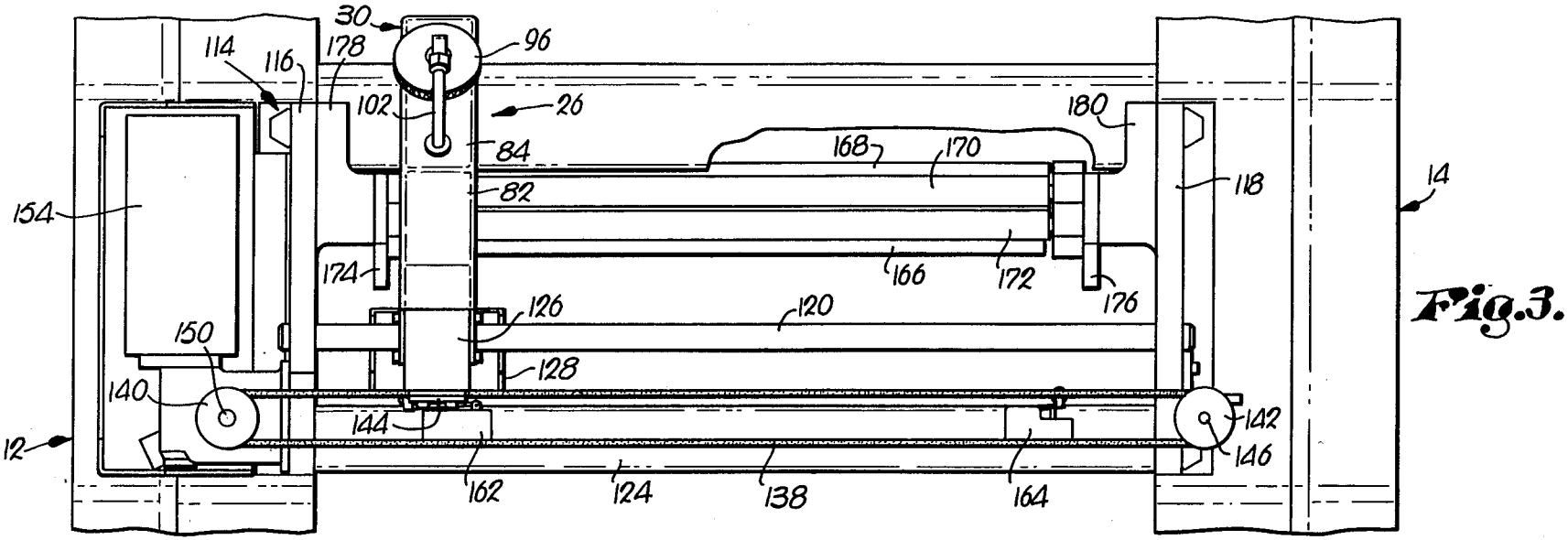
FIG. 3 is a fragmentary top view with parts broken away for clarity which further illustrates the construction of the inking assembly.
Figure 2:
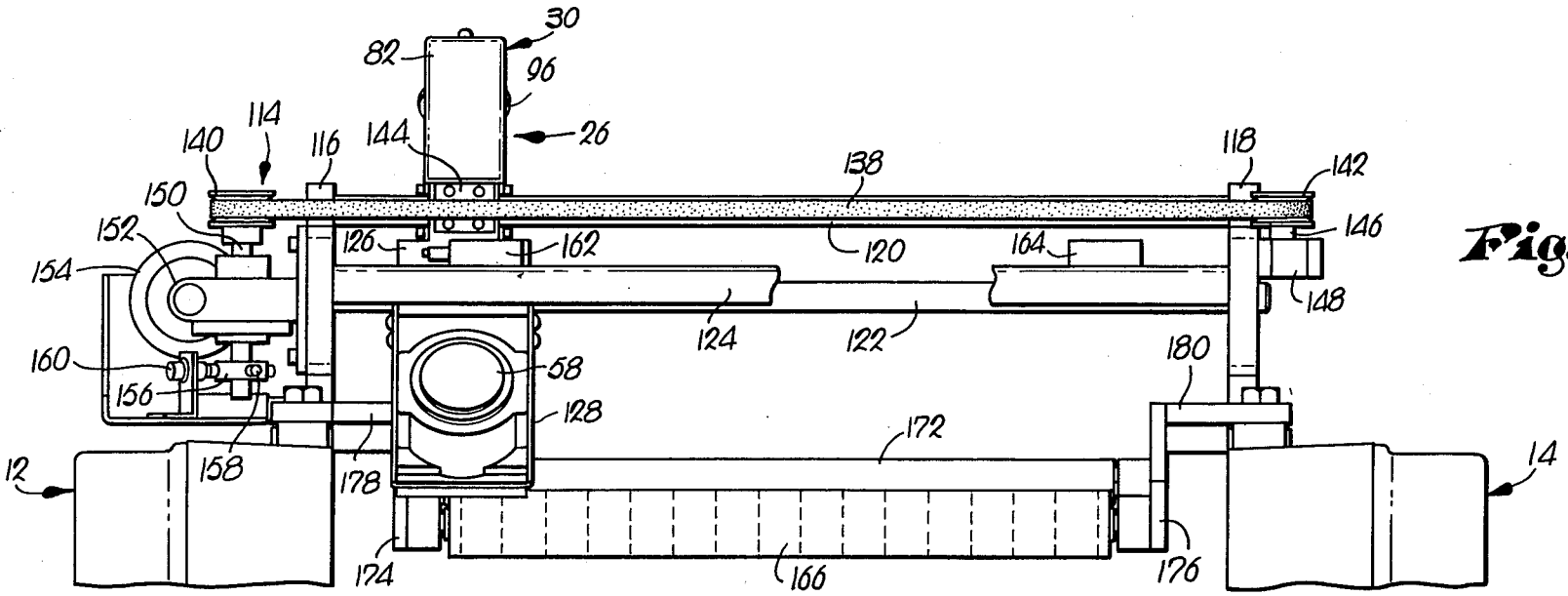
FIG. 2 is a fragmentary side view with parts broken away for clarity illustrating details of construction of the preferred inking assembly.

Turning now to the drawing, a printing press 10 is illustrated in FIGS. 1–3. The press 10 broadly includes a pair of laterally spaced apart sidewalls 12, 14, together with a pair of relatively large plate and blanket rollers 16, 18 and a corresponding impression roller 19. The plate roller 16 as best seen in FIG. 1 is in operative engagement with an inking roller train broadly referred to by the numeral 20. Finally, the overall press 10 includes an inking assembly 22 designed for applying ink to the uppermost roller of train 20 as will be described below.

In the normal operation of press 10, a continuous web of paper 24 is fed to the nip defined between the rollers 18, 19 for purposes of imprinting on the web 24. During such operation, ink supplied from the inking assembly 22 is fed via the roller train 20 for ultimate application to the plate roller 16 and blanket roller 18, as those skilled in the art will readily appreciate. It will also be understood that the press 10 includes other conventional structure forming no part of the present invention, such as the usual dampening system.

The inking assembly 22 has an ink supply means 26 which is mounted for reciprocal, translatory movement between the sidewalls 12, 14. In detail, this ink supply means 26 includes an ink delivery means in the form of a nozzle 28, structure for supplying ink referred to by the numeral 30, and feeding means 32 operatively coupling the ink supply means 30 and the nozzle for selective delivery of ink from the supply to the nozzle.

Referring specifically to FIGS. 4–6, it will be seen that nozzle 28 is in the form of an elongated, tubular body presenting a flattened outermost delivery end 34. The end of nozzle 28 remote from the flattened end 34 is operatively coupled to a feeding means 32, preferably in the form of a pump device. In particular, the feeding means includes an elongated housing 36 with a forward or lower end cap 38. The cap 38 is centrally apertured as at 40 in order to receive the end of nozzle 28, and a sealing ring 42 is situated between the inner face of cap 38 and the defining sidewall of housing 36 as will be readily seen from a study of FIGS. 4 and 5.

The pumping device also includes a pair of elongated, flighted, intermeshed, counter-rotating screw elements 44, 46 which are situated within housing 36. As best seen in FIG. 5, each of the elements 44, 46 includes a forwardly extending journal extension 48, 50 which is in turn received within a corresponding journal recess provided in end cap 38. In like manner, each screw element includes a rearwardly extending drive extension 52, 54; these extensions 52, 54 extend through a back plate 56 which closes the upper or rearward end of the housing 36.

The motive drive for the pumping device is advantageously in the form of a stepper motor 58. This stepper motor is of conventional construction and includes a central output shaft 60 having an outermost pinion gear 62 affixed thereto. A driving connection between stepper motor 58 and the rotatable screw elements 44, 46, is effected by means of a gear train including intermediate gears 64, 66, and respective driven gears 68, 70 affixed to the innermost ends of the drive extensions 52, 54. As will be observed from a study of FIG. 5, the gears 64, 66 are interconnected by conventional means 72 for rotation in unison. Moreover, it will be seen that the gear 64 is in meshed engagement with gear 62, and that the gear 66 is in driving engagement with the element driving gears 68, 70. Hence, rotation of stepper motor output shaft 60 serves to correspondingly rotate the screw elements 44, 46 in the manner well known to those skilled in the art.

Turning now to FIG. 4, it will be seen that the upper wall portion of housing 36 is provided with a threaded bore 74 so as to afford communication to the interior chamber defined by the housing. A flat, annular, disk-like member 76 is affixed to the upper wall portion of housing 36 and affords connection with the ink supply to be described hereinafter. In particular, the disk member 76 includes a depending, annular, externally threaded boss 78 which is threadably coupled with the threads of bore 74 as will be seen in FIG. 4. Moreover, the disk member 76 is also provided with a smooth ink supply bore 80 therethrough which is coaxial with threaded bore 74.

The overall ink supplying means 30 includes an irregularly shaped Z-bracket 82 having an angularly oriented uppermost arm 84. The arm 84 is apertured as at 86 and is provided with an annular, internally threaded attachment collar 88 coaxial with the aperture 86. In addition, an elongated, externally threaded, annular connector 90 is threadably secured to the collar 88. The lowermost end of the connector 90 as viewed in FIG. 4 is provided with an elastomeric, annular sealing member 92 presenting a frustoconical lowermost sidewall 94. The upper end of connector 90 is provided with a radially enlarged, knurled connector disk 96 which permits selective threaded movement of the connector 90 relative to the arm 84.

The aforementioned components cooperatively define an elongated air delivery bore 98 extending through the element 90 and sealing member 92, which is important for purposes to be described. Delivery of pressurized air to the bore 98 is effected by means of a conventional swivel connector 100 operatively secured to disk 96, together with an air line 102 and coupler 104.

It will be observed that the arm 84 and its associated structure is vertically spaced above the feeding means 32. This space accommodates an elongated, tubular, ink-holding cartridge 106 which holds a supply of the viscous, gel-like printing ink 108 to be used in press 10. The cartridge 106 has a surrounding tubular sidewall as depicted, together with an internal, slidably mounted piston 110 in direct contact with the upper surface of the ink 108. The overall cartridge further includes an ink outlet extension 112 which is designed to fit within the bore 80 of disk member 76. It will thus be appreciated that the ink cartridge 106 is positioned within the ink supplying means 30 by inserting the extension 112 into bore 80, and by affixing the sealing member 92 within the opposite open end of the cartridge. Relatively low pressure air (e.g. 6 pounds per square inch) is applied during operation through line 102 and the associated connection structure for delivery against the face of piston 110 remote from ink 108, in order to maintain a continual bias against the piston and thus ensure smooth flow of ink from the cartridge into the internal chamber of housing 36. It will be appreciated that lower viscosity inks can flow downward into bore 80 without use of piston 110 or air pressurization.

The inking assembly of the invention also includes means broadly referred to by the numeral 114 for mounting the ink supplying means 26 with the nozzle 28 thereof adjacent at least one appropriate ink-receiving roller in order to deposit ink onto such roller(s), and for translatory movement of the ink supply means 26 along a path of travel extending axially of the ink-receiving roller. Most advantageously, the nozzle 28 is oriented for depositing ink into the incoming nip region presented by a pair of oppositely rotating ink-receiving rollers. This structure 114 includes a pair of upstanding side frames respectively secured to and extending upwardly from the underlying press sidewalls 12, 14. A pair of elongated, transversely extending guide rods 120, 122 extend between and are rigidly affixed to the plates 116, 118, together with a spanning spacer channel 124. A shiftable carriage block 126 is mounted on the rods 120, 122 by means of ball bushings and is thus movable along the length thereof. A depending metallic bracket 128 is secured to the lower end of carriage block 126, and supports stepper motor 58. To this end, the bracket 128 includes a lower transverse stretch 130 which is apertured as at 132 in order to accommodate the output shaft 60 of stepper motor 58. In addition, a support block 134 is affixed to the stretch 130 and is configured for supporting the feeding pump 32.

The end of bracket 82 remote from the arm 84 is also affixed to the upper end of carriage block 126, by means of screws 136. The entire ink supply means 26 is thus laterally shiftable with carriage block 126 between the upstanding frames 116, 118.

The mounting means 114 also includes an elongated, continuous, toothed loop timing belt 138. This belt 138 is supported at respective ends thereof by corresponding pulleys 140, 142. Moreover, it will be seen that the carriage block 126 is secured to belt 138 by means of a threadably secured clamping plate 144; hence, movement of the belt 138 in turn causes movement of the carriage block 126 and therefore the entire ink supply means 26.

Referring specifically to FIG. 2, it will be seen that the pulley 142 is rotationally mounted on a shaft 146, the latter in turn being mounted on a block 148 affixed to upstanding plate 118. On the other hand, pulley 140 is mounted for rotation on a vertical shaft 150, the latter being operatively coupled with a gear drive 152. This gear drive is connected to the output of a gear motor 154 designed for powered rotation of shaft 150 and hence movement of belt 138. The motor 154 is supported on an appropriate bracket or mount affixed to upstanding side plate 116, as will be readily seen from a study of FIGS. 2 and 3.

In order to provide operational control for the translatory movement of the ink supply means 26, appropriate sensing controls are provided. To this end, the lowermost end of shaft 150 is provided with a collar 156 having thereon a plurality of circumferentially spaced magnets 158. A magnetic sensing device 160 is situated adjacent collar 156, and is designed to detect rotational movement of collar 156, and hence the corresponding position of carriage block 126 and thus ink supply means 26 along its path of travel between the plates 116, 118. In addition, a pair of limit switches 162, 164 are secured to the channel 124 as illustrated, in order to sense the termination of movement of the ink supply means 126 in a given direction, and to initiate return movement thereof toward the opposite limit switch. In addition, a sensor 165 (FIG. 7) is provided for detecting the amount of rotation of the press rollers, which is important for purposes to be described.

The preferred add-on inking assembly of the invention is also provided with an ink-receiving roller 166 directly adjacent and beneath the nozzle 28, and a total of three smaller rider rollers 168–172 in contact with roller 166. As best seen in FIG. 1, nozzle 28 is oriented for delivery of ink into the incoming nip region presented by the oppositely rotating rollers 166, 172, i.e., the nozzle 28 is located adjacent the side of the nip region where the adjacent surfaces of the rollers 166, 172 converge toward each other during rotation. The rollers 166–172 are supported by means of a pair of laterally spaced apart, depending marginal mounting plates 174, 176. These plates 174, 176 are operatively coupled to the associated upstanding plates 116, 118 by means of respective, irregularly shaped connector plates 178, 180.

As noted previously, the add-on inking assembly of the present invention is adapted for mounting on a conventional printing press. In the particular press illustrated in the drawings, the sidewalls 12, 14, printing rollers 16, 18, and the majority of the inking train 20 is preserved and used. That is to say, in a normal unmodified press of the type depicted, an ink fountain, fountain roller with doctor blade and ductor roller are employed together with the remainder of the ink train beneath the previously described ink-receiving roller 166. When use is made of the add-on inking assembly of the invention, however, the fountain, fountain roller, doctor blade and ductor are removed or simply not used, and the inking assembly is secured to the press by affixing the upstanding side plates 116, 118 to the associated press sidewalls 12, 14. As such, it will be seen that modification of the conventional press to make use of the improved inking assembly of the invention is a simple matter which can be readily accomplished without extensive press modifications.

Generally speaking, during the operation of the inking assembly of the invention, ink is ejected from nozzle 28 as the ink supply means 26 moves along the length of ink-receiving roller 166. This ink is then transferred in the usual fashion to the inking roller train 20, for ultimate application to plate roller 16 and web 24. In practice, ink is applied only during the passage of ink supply means 26 from limit switch 162 to limit switch 164. During the return movement of the ink supply means to the starting position corresponding to limit switch 162, no ink is applied; moreover, this return movement is typically much faster than the ink-applying movement between the switches 162–164.

In addition, the assembly 22 is operated in such fashion that the ink-receiving roller is divided into successive ink-receiving zones. By way of example, and for illustrative purposes only, FIG. 2 depicts roller 166 with a series of dotted lines which divide the roller into successive zones. These zones may be of variable width, but in practice one and one-eighth inch wide zones have been found acceptable. As the ink supply means enters each zone, the stepper motor is immediately activated to deliver an appropriate, predetermined quantity of ink to the respective zone. This is done on a time basis, i.e., the stepper motor is operated for a period to apply the necessary ink, whereupon stepper motor operation is terminated until the ink supply means reaches the next zone. As such, it will be appreciated that ink may not be actually applied over the entire zone width. This has not been found to present significant problems, however, in view of the selected zone widths and the fact that the downstream ink train rollers serve to adequately spread the applied ink over the zone in question. While timed stepper motor application of ink has been proved satisfactory and is presently preferred, it is also within the ambit of the invention to apply ink at a rate designed to distribute the ink over more of or over the entire width of the corresponding zones. By virtue of this operation, it will be seen that the twin screw ink feeding pump serves to create successive charges of pressurized ink which are ejected from the nozzle 28 during traversal of the corresponding zones; these charges are moreover delivered at a constant flow rate. This mode of timed stepper motor operation has been found to be advantageous in that it affords precise, yet easily variable ink control.

It is believed that the foregoing description of the structure and operation of the inking assembly 22 of the invention is in and of itself sufficiently detailed to allow those skilled in that art to make and use the invention. Such artisans will of course appreciate that a variety of conventional controls can be employed for effecting the type of operation described. However, in order to ensure completeness, the following discussion is given of the presently preferred apparatus and computer-controlled method of operation.

Figure 7:
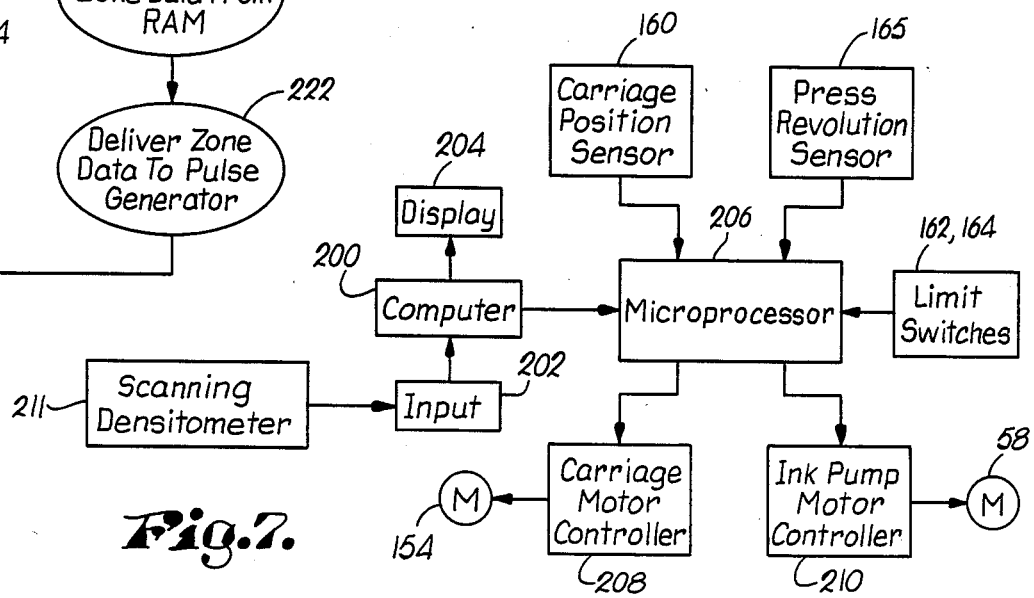
FIG. 7 is a schematic block diagram illustrating the various components of the control apparatus of the inking assembly.

Attention is first directed to FIG. 7, which is a schematic block diagram depicting appropriate control apparatus for the invention. To this end, a conventional personal computer 200 is provided which includes the usual electronic interface input 202 and a display 204. Computer 200 is operatively coupled with a preprogrammed microprocessor 206. In addition to the computer input, the microprocessor has additional inputs in the form of the carriage block position sensor 160, the press revolution sensor 165, and limit switches 162, 164. As explained previously, the sensor 160 detects the position of carriage block 126 along the path of travel thereof, whereas the sensor 165 detects the rotational position of the primary roller 16.

The microprocessor 206 is connected to a carriage motor controller 208 which is in turn coupled with gear motor 154 for forward or reverse operation thereof. Moreover, the microprocessor is connected to an ink pump motor controller 210, the latter being coupled to and controlling the stepper motor 58.

The computer input 202 may be a keyboard, in which case the operator would manually enter data corresponding to the amount of ink desired in each ink-receiving zone, such data being derivable from the operator's own observations or from a scanning device.

FIG. 7 also schematically depicts one possibility in this regard, i.e., scanning densitometer 211 which can be employed to supply appropriate ink coverage data for the copy to be printed to computer 200. Typically, a prepared printing plate for the desired copy is scanned using densitometer 211, and the resultant data is delivered through input 202 to computer 200. Densitometer 211 in effect divides the copy or printing plate into columns or zones corresponding to the ink-receiving zones on the press, and determines the amount of ink density required for each respective zone in the copy to be printed.

Figure 8:
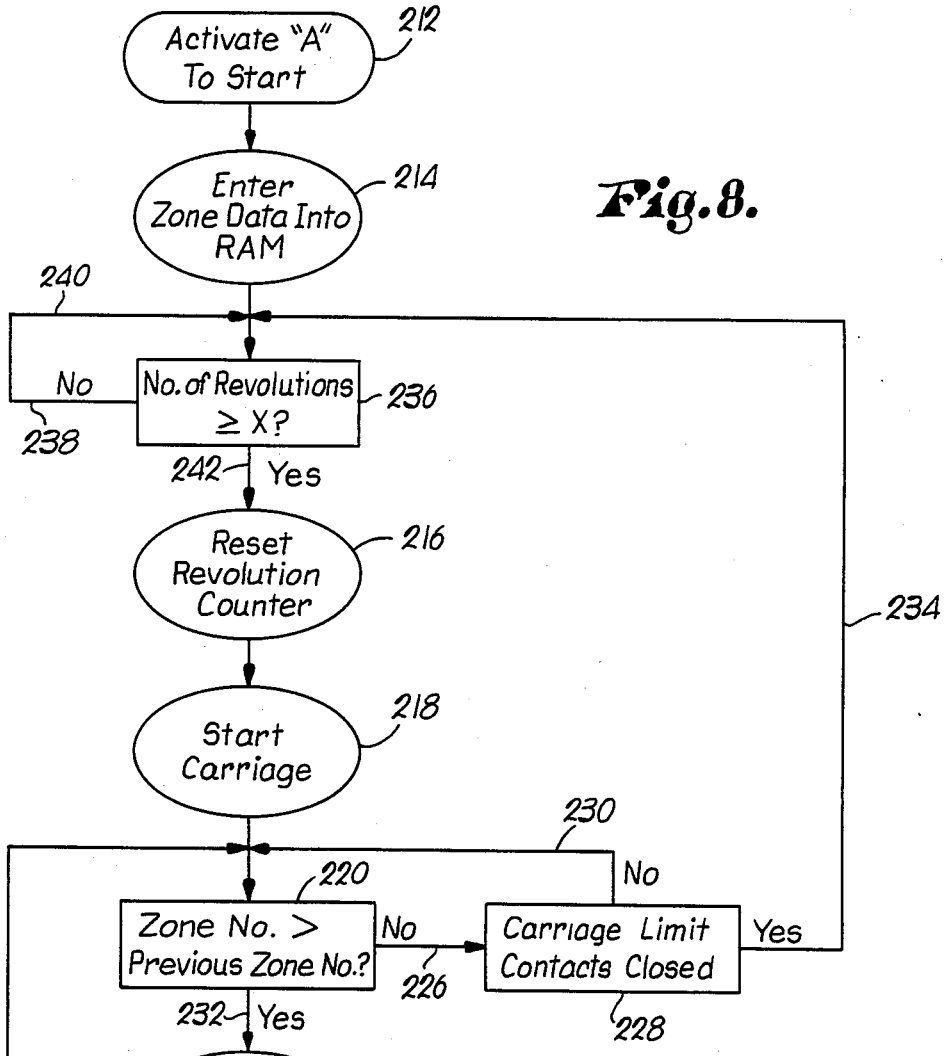
FIG. 8 is a flow chart illustrating in simplified form the manner of microprocessor control used in the present invention to control the operation of the inking assembly.

The sequential control operation of microprocessor 206 is illustrated in FIG. 8. For ease of discussion and to best illustrate the preferred mode of operation, it will be assumed that the operator has obtained the necessary densitometer data from the printing plate, and that such data has been delivered to computer 200, either by manual keyboard entry, or by electronic data transfer such as floppy disk storage. In the initial step 212, the operator enters the letter "A" on the keyboard of the computer 200; this transfers the zone-divided densitometer data from computer 200 to the random access memory [RAM] of the microprocessor, step 214. This input data, together with inputs from the sensors 160, 165, and limit switches 162, 164, is used in the microprocessor to control the operation of inking assembly 22.

The program loops around step 236 until the number of revolutions of the press equals or exceeds a preset number "X" held in the RAM. At this time the program moves on to step 216. The purpose of the delay loop around step 236 will become clear from the discussion below.

An output signal is next sent by the microprocessor to: (1) reset to zero the press roller revolution counter, step 216; and (2) activate carriage motor 154 through controller 208 to initiate translatory movement of ink supply means 26 from the limit switch 162 towards limit switch 164, step 218 (see FIG. 3). The supply means thus enters inking zone 1, such information being relayed to microprocessor 206 via sensor 160.

In the next step 220, a zone number comparison is set with the zone number "1" and zone data corresponding to inking zone 1 is retrieved from RAM, step 221. The program then delivers this zone 1 inking data, step 222, to the pulse generator of the microprocessor, which in turn causes the stepper motor 58 to step through the required number of steps to deliver the requisite quantity of ink to zone 1 of the roller 166. At this point the stepper motor is deactivated to stop ink delivery.

After initiation of step 222, the program loops back to step 220, and compares the preset zone number with the sensed position of the ink supply means 26 relayed by sensor 160, step 224. As long as the ink supply means 26 is traveling within zone 1, the comparator gives a "No" answer, step 226. The program then ascertains if the limit switches 162, 164 are closed, step 228. Since the ink supply means is traversing zone 1, a "No" answer is obtained, step 230. The program then loops back to continue the steps 220 through 222 as described above.

When the ink supply means 26 enters zone 2 however, such information is relayed by sensor 160 to the microprocessor 206. During a repeat loop step 230, the comparison step 220 then ascertains that the zone number 2 is greater than the previous zone number 1, thereby generating a "Yes", step 232. When this occurs, zone 2 data is retrieved from RAM, and the appropriate pulse data is sent to the pulse generator for activation of motor 58 for a time to give the desired ink application within zone 2 of the roller 166. Simultaneously, the comparator is reset with a "2" as the "Previous Zone No.", so that the repeat loop steps 230 will generate the desired "No" responses until zone 3 is reached by the ink supply means 26.

The progress of ink supply means along the length of roller 166 is thus continuously monitored and controlled until the last zone is reached and traversed, and limit switch 164 is closed. At this point during the repeat loop steps described, the step 228 generates a "Yes" answer. The microprocessor then sends a signal to controller 208 to reverse the operation of motor 154 and to increase the speed thereof in order to quickly return the ink supply means 26 to its start position with limit switch 162 closed. During such return movement no ink is applied to roller 166.

The program then follows step 234 to a press revolution comparison, step 236, which compares the number of press roller revolutions (relayed by sensor 165) with a predetermined revolution value "X" from RAM. This value "X" is chosen so as to permit sufficient time for the ink supply means to return to its start position. Thus, as long as the actual number of revolutions sensed by sensor 165 is less than "X", a "No" answer is generated, step 238, and the program goes through successive repeat comparison loops, step 240.

When the number of sensed press roller revolutions is greater than or equal to "X", a "Yes" answer is generated, step 242. This serves to restart the entire operational sequence, i.e., the counter is reset to zero, step 216, and carriage movement is initiated, step 218. The control apparatus and microprocessor program thereby serve to control the shifting movement and zone-by-zone ink application of the supply means 26 through successive passes along the length of roller 166.

We claim:

1. A lithographic printing press comprising:

an imprinting cylinder train having a plurality of elongated, axially rotatable cylinders including a pair of adjacent nip-defining cylinders for receiving therebetween a material to be imprinted;

an inking roller train having a plurality of elongated, axially rotatable inking rollers including an ink-receiving roller and at least one ink-transfer roller in operative contact with a cylinder of said imprinting train, for conveying ink from the ink-receiving roller to said imprinting train;

means for operatively supporting said imprinting and inking trains;

an inking assembly adapted for connection to a supply of viscous lithographic ink, said assembly including an inking element including an ink outlet for depositing ink onto said ink-receiving roller;

means for operatively coupling said element and said supply of ink for passage of ink from the supply to the element, including structure defining an ink-flow path leading from the supply to the element;

selectively actuatable ink-flow control means operatively interposed in said ink-flow path, said ink-flow control means including means for pressurizing ink received from said supply and supplying pressurized ink to said inking element, and for permitting selective, alternate delivery of ink from said outlet and termination of said ink delivery therefrom;

means for mounting said element adjacent said ink-receiving roller with the element outlet in an ink-depositing orientation, and for translatory movement of the element axially along the length of the ink-receiving roller; and operational means operatively connected with said ink flow control means for operation of the latter during said translatory movement of said element in order to deposit preselected variable quantities of ink onto said ink-receiving roller at different positions, said operational means comprising means for determining the position of said element along the length of said ink-receiving roller during said translatory movement of said element, and for producing a position signal indicative of a position of the element at at least certain locations along the path of travel of the element;

memory means for electronically storing data representative of said preselected variable quantities of ink to be deposited onto said ink-receiving roller at said different positions along the length thereof; and control means operatively coupled with said position-determining means, said memory means and said ink flow control means for receiving said position signals from said determining means, for selecting certain of said stored data in response to respective position signals, and for selectively actuating said ink flow control means in accordance with said selected data to deposit variable quantities of ink onto said ink-receiving roller at said different positions along the length thereof.

2. The press of claim 1, said inking element comprising a nozzle.

3. The press of claim 1, including structure supporting said supply of ink for translatory movement of said supply with said element.

4. The press of claim 1, said ink-flow control means comprising a pump and motive means operatively coupled with said pump, said ink flow control means being mounted for translatory movement thereof with said element.

5. The press of claim 1, said operational control means including structure for varying the flow rate of ink delivered from said outlet.

6. The press of claim 5, said flow-rate varying structure including means for selectively stopping and starting said ink-flow control means at selected times during said translatory movement of said element.

7. The press of claim 1, said mounting and moving means including means for translatory movement of said element at a constant translatory speed over a majority of the path of travel thereof during the time ink is being deposited on said ink-receiving roller.

8. The press of claim 1, said nip-defining cylinders being adapted for receipt of a continuous web of material therebetween.

* * * * *